US010786413B2

(12) United States Patent
Buehl

(10) Patent No.: US 10,786,413 B2
(45) Date of Patent: Sep. 29, 2020

(54) DEVICE AND METHOD FOR TRAINING

(71) Applicant: Elmar Buehl, Thiersee (AT)

(72) Inventor: Elmar Buehl, Thiersee (AT)

( * ) Notice: Subject to any disclaimer, the term of this patent is extended or adjusted under 35 U.S.C. 154(b) by 201 days.

(21) Appl. No.: 16/065,042

(22) PCT Filed: Dec. 22, 2016

(86) PCT No.: PCT/EP2016/082302
§ 371 (c)(1),
(2) Date: Jun. 21, 2018

(87) PCT Pub. No.: WO2017/109032
PCT Pub. Date: Jun. 29, 2017

(65) Prior Publication Data

US 2019/0022453 A1 Jan. 24, 2019

(30) Foreign Application Priority Data

Dec. 22, 2015 (DE) ..... 10 2015 122 637

(51) Int. Cl.
*A61H 1/02* (2006.01)
*A63B 21/00* (2006.01)
(Continued)

(52) U.S. Cl.
CPC ..... *A61H 1/0222* (2013.01); *A61H 1/02* (2013.01); *A61H 1/0218* (2013.01);
(Continued)

(58) Field of Classification Search
CPC ..... A61H 1/00; A61H 1/001; A61H 1/005; A61H 1/02; A61H 1/0218; A61H 1/0222;
(Continued)

(56) References Cited

U.S. PATENT DOCUMENTS 4,579,109 A * 4/1986 Lundblad ..... A61H 1/0222 606/242
4,895,328 A 1/1990 Ryan
(Continued)

FOREIGN PATENT DOCUMENTS

WO 2013/087001 A1 6/2013
WO 2014/202222 A1 12/2014

OTHER PUBLICATIONS

International Preliminary Report on Patentability issued in corresponding International Application No. PCT/EP2016/082302.
(Continued)

*Primary Examiner* — Colin W Stuart
(74) *Attorney, Agent, or Firm* — Studebaker & Brackett PC

(57) ABSTRACT

The invention relates to an apparatus and a method for training the muscles of the upper torso and/or for relaxing the spinal column of a person, with a movable carriage for receiving the person, and with a guide path along which the movable carriage with the person is guided and moved in such a way that kinetic energy is applied at least intermittently to the person for distraction of the torso or of the spinal column of the person. According to the invention, provision is made that the person on the movable carriage is received on the support lying in a substantially horizontal position, that the hips, legs and/or feet of the person on the support are fixed with a fixing arrangement, and that the movable carriage, with the person lying on it, is moved substantially horizontally along the guide path.

8 Claims, 3 Drawing Sheets

Figure 1:
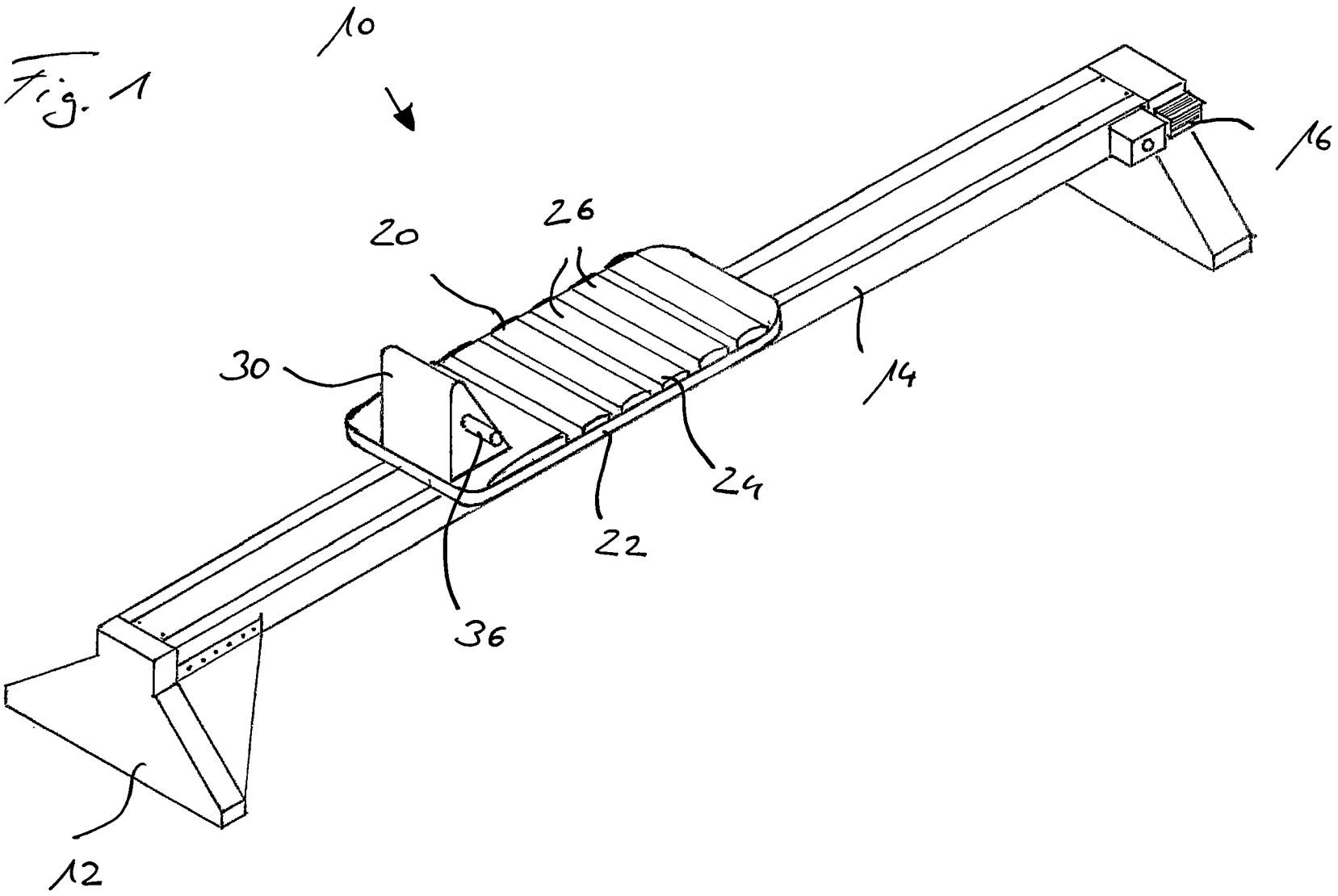

(51) Int. Cl.
*A63B 23/00* (2006.01)
*A63B 71/02* (2006.01)

(52) U.S. Cl.
CPC ..... *A61H 1/0292* (2013.01); *A61H 1/0296* (2013.01); *A63B 21/4045* (2015.10); *A61H 2001/0233* (2013.01); *A61H 2201/0134* (2013.01); *A61H 2201/0138* (2013.01); *A61H 2201/0142* (2013.01); *A61H 2201/0149* (2013.01); *A61H 2201/163* (2013.01); *A61H 2201/1623* (2013.01); *A61H 2201/1633* (2013.01); *A61H 2201/1642* (2013.01); *A61H 2201/1664* (2013.01); *A61H 2203/0443* (2013.01); *A61H 2203/0456* (2013.01); *A61H 2203/0462* (2013.01); *A61H 2205/081* (2013.01); *A63B 2023/006* (2013.01); *A63B 2071/025* (2013.01); *A63B 2220/51* (2013.01); *A63B 2225/093* (2013.01)

(58) Field of Classification Search
CPC ..... A61H 1/0292; A61H 1/0296; A61H 2001/0233; A61H 2201/0119; A61H 2201/0149; A61H 2201/1602; A61H 2201/1609; A61H 2201/1623; A61H 2201/1664; A61H 2201/163; A61H 2201/1633; A61H 2203/04; A61H 2203/0443; A61H 2203/045; A61H 2203/0456; A61H 2203/0462; A61H 2203/0481; A61H 2203/0493; A61H 2203/0487; A61H 2205/08; A61H 2205/081; A63B 21/4045; A63B 21/40; A63B 21/4003; A63B 21/4027; A63B 21/4029; A63B 21/4031; A63B 21/4041; A63B 21/4043; A63B 2023/006; A63B 2220/51; A63B 2220/52; A61F 5/00; A61F 5/04; A61F 5/042; A61F 5/048; A61F 2005/0153
See application file for complete search history.

(56) References Cited

U.S. PATENT DOCUMENTS

| | | | | |
|---|---|---|---|---|
| 5,505,691 | A * | 4/1996 | Fenkell | A61H 1/0222 601/116 |
| 6,039,737 | A * | 3/2000 | Dyer | A61H 1/0222 606/54 |
| 7,883,444 | B1 * | 2/2011 | Wu | A61H 1/02 482/1 |
| 2005/0101462 | A1 | 5/2005 | Atwell | |
| 2007/0293796 | A1 | 12/2007 | Graham | |
| 2008/0269030 | A1 * | 10/2008 | Hoffman | A61H 1/0218 482/142 |
| 2009/0247917 | A1 * | 10/2009 | Park | A61H 1/0222 601/99 |
| 2014/0100503 | A1 | 4/2014 | Liao | |
| 2014/0364910 | A1 * | 12/2014 | Ren | A61F 5/042 606/242 |

OTHER PUBLICATIONS

International Search Report issued in PCT/EP2016/082302; dated Mar. 24, 2017.

* cited by examiner

DEVICE AND METHOD FOR TRAINING

The invention relates to a device for training the muscles of the upper torso and/or for relaxing the spinal column of a person, with a displacement carriage for receiving the person and with a guide track, along which the displacement carriage with the person is guided and movable in such a manner that kinetic energy is exerted at least temporarily onto the person for distraction of the torso or spinal column of the person.

The invention further relates to a method for training the muscles of the upper torso and/or for relaxing the spinal column of a person, with a displacement carriage for receiving the person and with a guide track, along which the displacement carriage with the person is guided and moved in such a manner that kinetic energy is exerted at least temporarily onto the person for distraction of the torso or spinal column of the person.

A generic prior art can be taken from US 2014/0100503 A1. A supporting base is provided with a displacement carriage, on which a hip region of a person to be treated rests and is tightened. At least the upper body of the person is tightened on the stationary supporting base. By means of a tension spring the displacement carriage with the hip can be displaced, whereby a tensile force is applied to the spinal column of the person.

A device and a method for training the torso muscles can be taken from WO 2014/202222 A1. In this known device a running carriage substantially displaceable in the vertical direction is supported in a displaceable manner along a vertical linear guide. On the running carriage a seating surface is provided for the person to be treated who can furthermore support him- or herself on arm pads. During reversing up-and-down movement of the person the seating surface is displaced downwards at specific intervals, whereby a particularly good effect of distraction of the spinal column of the person to be treated can be achieved. This distraction has a relaxing and altogether very positive impact on the back muscles as well as the spinal column and the intervertebral disks. However, the support of the person on arm pads in combination with greater heights that can be reached in the case of longer displacement distances can be perceived as non-relaxing by some patients. This can lead to cramping concerning persons to be treated which counteracts an intended distraction of the spinal column.

A further device for relief of the spinal column is known from U.S. Pat. No. 4,895,328. In this device the person to be treated is arranged in a lifting frame with arm pad. By means of a cable pull the lifting frame can be pulled upwards, while the person supports him- or herself by the forearms on the arm pad. In doing so, the spinal column is relieved and expanded as a result of the proper weight. Thus, also in this known device an active support of the person to be treated by way of arm pads is necessary.

For specific groups of persons, for instance those with weakened or injured arm or torso muscles, a support by arm pads is not suitable at all or to a certain extent only.

The invention is based on the object to provide a device and a method which enable a training of the muscles of the upper torso or a relaxation of the spinal column in a particularly gentle and efficient manner.

The device according to the invention is characterized in that the displacement carriage is designed with a pad for receiving the person reclining in a substantially horizontal position, in that the pad is provided with a fixing means for fixing the hips, legs and/or feet of the person and in that for horizontal displacement of the displacement carriage with the reclining person the guide track runs horizontally.

Furthermore, the method according to the invention is characterized in that the person is received on the displacement carriage by reclining on a pad in a substantially horizontal position, in that hips, legs and/or feet of the person are fixed on the pad with a fixing means and in that the displacement carriage with the reclining person is displaced along a guide track in a substantially horizontal manner.

A basic idea of the invention resides in abandoning an arm pad of a person to be treated and in arranging the person to be treated in a completely reclining manner in a substantially horizontal position. A reclining position is normally perceived as being particularly relaxing and can also be assumed without difficulty by weaker or older persons or those having injuries on the arms or the torso.

Another aspect of the invention resides in the fact that the fixation of the person on the displacement carriage is provided in the region of the hips (pelvis), legs or feet. Hence, on corresponding horizontal displacement of the person the effect of mass inertia occurring in certain acceleration or braking processes can be used for a selective distraction of the torso or spinal column. A fixation in the pelvic and hip region or on the thighs proves to be favorable since the joints and ligaments are particularly strongly developed in this region.

A particular advantage of the invention resides in the fact that a tensile force is not only exerted onto the spinal column below the clavicle but at the same time a tensile force is also exerted onto the cervical spine so that in one movement different forces, so to speak, are exerted as tensile stress in inverse proportion to the normal compressive stress of all individual vertebrae. Hence, relatively small forces are exerted onto the cervical spine as only the head acts as an inert mass, whereas in the case of vertebrae located further downwards the additional mass of the upper body segments serves as a tensile force and is therefore correspondingly higher. The lumbar vertebrae thus experience the highest tensile stress, as the entire upper body together with the head acts as tensile force onto these vertebrae.

According to the intensity of the braking force or length of the brake ramp any conceivable force can in principle be exerted onto the spinal column and its muscles. However, this force is limited to a maximum degree by suitable measures.

Moreover, due to the fact that in the treatment position no force has to be applied by the person him- or herself, as would be necessary when supporting oneself by the arms for example, the person to be treated can relax very well. This has a positive effect on the intended distraction of the torso, the back muscles or the spinal column. All in all, an especially good training of the muscles of the upper torso or an especially good relaxation of the spinal column can thus be achieved for a large group of persons.

A particularly preferred embodiment of the invention resides in the fact that the guide track is of linear or ring-shaped design. In the case of a linear guide track a reversing movement of the displacement carriage is provided in particular. The reclining person is orientated with his or her longitudinal direction in the displacement direction. Alternatively, provision can also be made for a ring-shaped guide track, in which case a continuous movement of the displacement carriage in one displacement or rotational direction is given. In a ring-shaped arrangement, which preferably is of circular or oval-shaped design, the displacement carriage with the reclining person is directed radially outwards in the longitudinal direction of the person. Especially in the case of an oval ring shape, given the changing radius of curvature, different centrifugal forces can be exerted onto the torso muscles or the spinal column of the reclining and radially outward directed person. In closed ring-shaped guide tracks uniform (circular shape) or increasing and decreasing distraction forces (oval ring shape) can be set over a longer period of time.

According to a further development of the device according to the invention it is advantageous for the pad to have a reclining surface for the torso of the person, wherein the reclining surface is designed to enable a relative movement of the torso with respect to the fixing means. The relative movement can amount to a relatively small value of preferably a few centimeters, in particular 1 to 5 cm. This can be achieved, for example, by friction-reducing elements, such as rolls, balls or a sliding surface on the reclining surface or burls that can be pivoted in the running direction, flaps, ribs or other adjustable pad elements. Basically, it is also possible that the reclining surface, on which the torso of the person lies, is supported in an axially displaceable manner in the displacement direction with respect to the remaining pad element. This can be achieved, for example, by a suitable linear guide between a base body of the pad and the reclining surface.

A particularly convenient use of the device according to the invention is accomplished in that in order to receive the person the pad can be pivoted at least partially into an upright receiving position. For this purpose, the displacement carriage can be displaced into the receiving position and at least parts thereof can be pivoted in such a manner that a seat- or chair-like receiving position is reached. From this receiving position the pad with the received person can then be pivoted gently into the reclined treatment position.

According to an embodiment of the invention a further improvement is achieved in that on the pad a support is provided which preferably has a prismatic shape and is designed for supporting the legs in an upward-bent position. A person reclining with bent legs relaxes the upper body in addition. In the region of the support, which can be a cushioned element, the fixing means can be attached.

According to a further development of the invention another improvement on handleability is attained in that hand grips are preferably attached in the region of the support. The hand grips can substantially be two pin- or bolt-like grips that extend transversely to the displacement direction on both sides of the displacement carriage. Through a positioning means the hand grips can be adjustable into a position that is ergonomically favorable to the patient. The hand grips are arranged such that the arms are in a substantially horizontal position. The position of the arms can be assisted by an arm-bearing surface, wherein this bearing surface substantially bears the weight of the arms only.

In accordance with an embodiment of the invention an especially expedient operation is achieved in that on at least one of the hand grips a regulating and/or switching means is arranged. In particular, the regulating and/or switching means can be designed such that through this a speed, acceleration or switch-over points can be set by the patient him- or herself. The regulating and/or switching means can also comprise an emergency stop switch. This enables the patient to terminate the treatment and operation of the device at any time.

For the drive of the displacement carriage any suitable motor, such as an electric, magnetic, hydraulic or pneumatic drive, can basically be provided. The drive can be provided on the carriage so as to form a direct drive or on the guide track, in which case a force transmission to the displacement carriage is effected by means of a traction rope for example. By preference, a speed ranging between 1 and 10 m/s, preferably ranging between 1 and 3 m/s, is achieved.

According to the invention it is of advantage that in the case of a linear guide track a drive for reversing displacement of the displacement carriage with a defined speed progression is provided. Through a control the drive is controlled such that a strong positive or negative acceleration is always exerted onto the reclining person in such a manner that relatively great forces desired for distraction of the torso muscles or spinal column are produced. In the reverse direction, only a gentle positive or negative acceleration is provided in each case so that barely noticeable compressive forces are developed on the torso muscles or spinal column.

The method according to the invention is furthermore characterized in that in the case of a linear guide track, on a forward path the displacement carriage with the person reclining in the displacement direction is initially accelerated gently and then braked strongly, wherein a distraction of the torso and/or the spinal column takes place, and in that subsequently, on the return path the displacement carriage with the reclining person is accelerated strongly and then braked gently, wherein during the acceleration a distraction of the torso and/or the spinal column takes place. In this embodiment the person lies headlong in the displacement direction on the forward path. By preference, provision is made in that two thirds of the displacement path are intended for a gentle positive or negative acceleration, while approximately one third of the displacement path is intended for a strong acceleration or braking.

Figure 2:
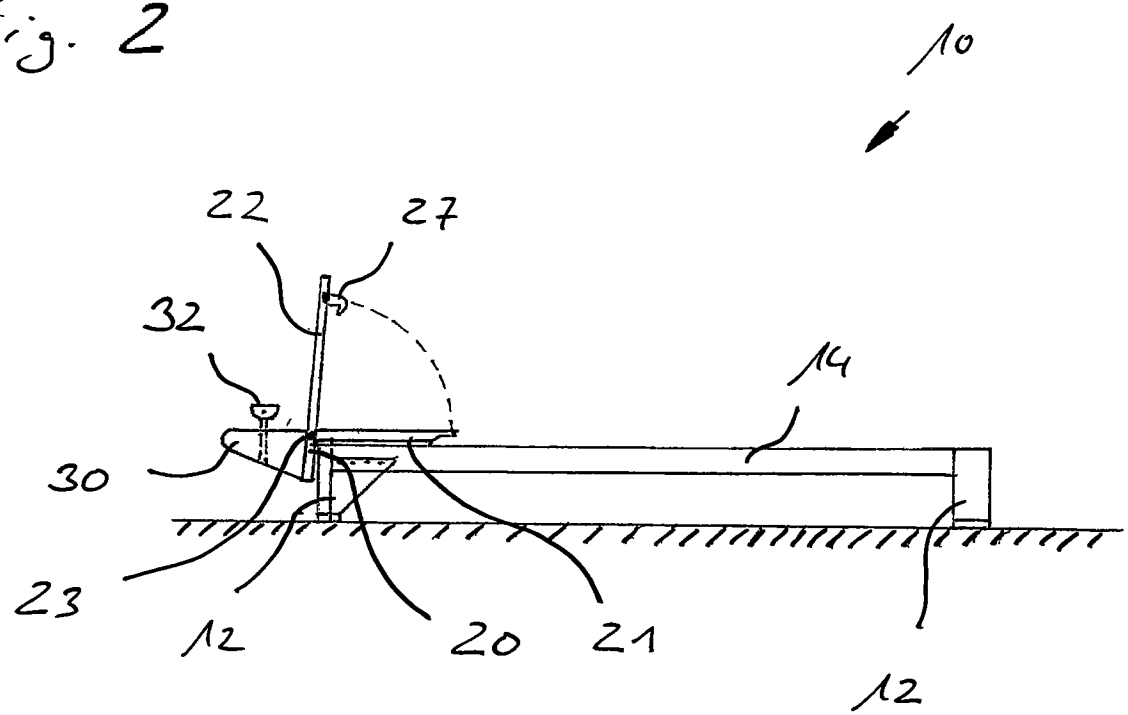
Figure 3:
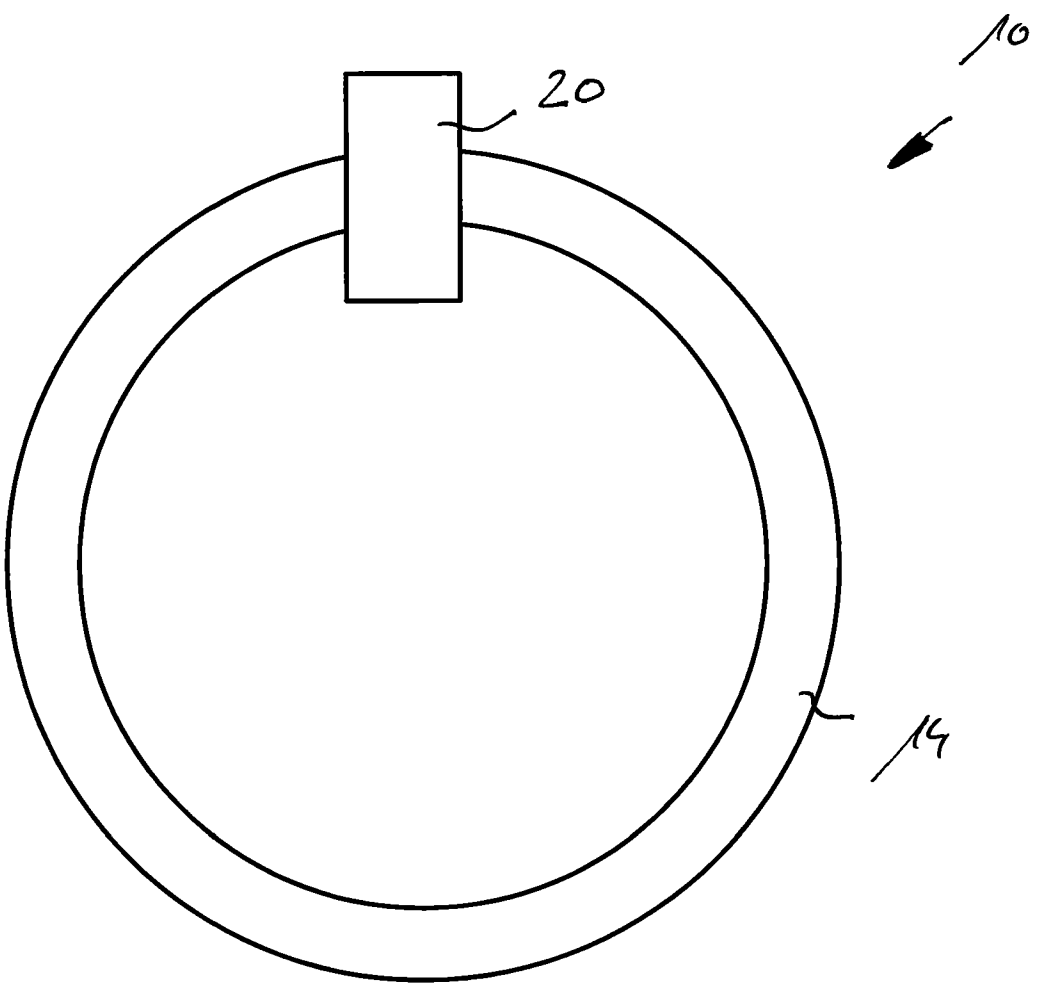

The invention is described further hereinafter by way of preferred embodiments illustrated schematically in the accompanying drawings, wherein show:

FIG. 1 a perspective view of a first embodiment of the device according to the invention;

FIG. 2 a schematic scaled-down side view of the device of FIG. 1 in a receiving position and FIG. 3 a highly schematic top view of a second embodiment of the invention.

A device 10 for training the muscles of the upper torso and/or for relaxing the spinal column is illustrated in FIG. 1. On a rack-like base frame 12 a linear guide track 14 is arranged which has a length of several meters. Along the upper side of the guide track 14 a displacement carriage 20 is supported in a linearly displaceable manner.

The displacement carriage 20 has a plate-shaped pad 22 which is designed as a cushioned reclining surface 24 to receive a person in a reclining, i.e. horizontal manner. By way of example, the displacement carriage 20 has a length of approximately 1.5 m and a width of approximately 80 cm. Other dimensions are possible without difficulty. The reclining surface 24 is provided with transversely running deflectable cushioned ribs 26 which allow a certain shift in the axial displacement direction of the torso of the reclining person.

In its lower foot region the displacement carriage 20 has a prismatic support 30 which is designed to receive the legs of the reclining person in a bent or crouched manner. In this arrangement the support 30 causes the knees of the reclining person to be directed upwards away from the displacement carriage 20. By way of a fixing means 32 illustrated in FIG. 2 the legs of the reclining person can be fixed in the region of the thighs on the support 30. In this way, the lower body region of the reclining person is fixed on the displacement carriage 20 while the torso region of the person lying on the reclining surface 24 is, to a certain extent not exceeding a few centimeters, supported in a shiftable manner in the displacement direction due to the deflectable cushioned ribs 26. Through a drive 16 the displacement carriage 20 can be driven and displaced in a reversing manner along the guide track 14 with defined acceleration speeds. The carriage 20 can be displaced via a non-depicted traction rope, chain, toothed belt or spindle gearing by means of the laterally attached drive 16. The drive 16 can be operated electrically, hydraulically, pneumatically or magnetically.

Control of the drive 16 can be effected by a separate operating panel, not illustrated. Moreover, on the support 30 on the displacement carriage 20 two laterally protruding hand grips 36 are arranged. The hand grips 36 can be gripped by the reclining person, wherein on the hand grips 36 a non-depicted regulating and/or switching means, in particular also an emergency stop switch, is arranged to control the drive 16.

As can be taken from FIG. 2, the displacement carriage 20 can be displaced into a lateral end or receiving position. In this receiving position the pad 22 of the displacement carriage 20 can be pivoted at least partially via a folding joint 23 into an approximately vertical position, while a base element 21 of the displacement carriage 20 remains in the guide track 14. Pad 22 and base element 21 can be releasably connected to each other by a locking means 27. In the illustrated receiving position it is particularly easy for the person to be treated to get on or get off the displacement carriage 20 in a seat position. Once the person is fixed with the fixing means 32 in the region of the legs on the displacement carriage 20, the pad 22 is pivoted back into the horizontal operating position.

On a forward path, the displacement carriage 20 with the person reclining thereon is initially accelerated gently to a speed which can amount to 4 m/s for example. Other speed values are possible depending on the dimensioning of the device. After approximately ⅔ or ¾ of the displacement path the displacement carriage 20 with the person is braked strongly, whereby due to mass inertia the torso region of the person lying on the reclining surface 24 is shifted relative to the displacement carriage 20 in the direction of displacement while the leg region of the person remains firmly attached to the support 30. The shifting of the torso region of the person is assisted by the transversely running deflectable cushioned ribs 26 of the reclining surface 24. In this way, the torso region with the torso muscles and the spinal column experiences a distraction, i.e. an extension in the direction of displacement. This relieves the muscles as well as the intervertebral disks which is perceived as particularly relaxing and restorative.

Before or on reaching an upper end point the displacement carriage 20 is braked completely. This is followed by a return path with a strong acceleration on approximately the first third of the return path. In this process, a distraction effect on the torso of the reclining person is achieved, too. Afterwards, a gentle, careful braking of the displacement carriage 20 takes place until the starting or initial position at the other end of the guide track 14 is reached again. Subsequently, a new displacement cycle can begin.

During this reversing displacement of the displacement carriage 20 an increasing and decreasing distraction is exerted onto the torso muscles of the reclining person. This relaxes and relieves the torso muscles as well as the spinal column with the intervertebral disks. Furthermore, due to a certain pumping effect the increasing and decreasing relief leads to a very good fluid supply of the intervertebral disks.

The device 10 according to the invention can be used both as a training means for training and relaxing the torso muscles, especially the back muscles, and for the relief and treatment of the spinal column and the intervertebral disks. Application in gyms or fitness centers, with physiotherapists, remedial physical therapists or usage in sports medicine or general medicine are possible.

According to FIG. 3 a further embodiment of the invention is illustrated schematically, in which the guide track 14 is of circular design. The displacement carriage 20, illustrated schematically only, is designed such that the reclining person lies with the head directed radially outwards. The leg region is fixed on the radial inner end of the displacement carriage 20. With this circular device 10 a uniform and long-lasting stretching of the torso muscles and/or the spinal column can be achieved.

The invention claimed is:

1. A device for training muscles of an upper torso and/or for relaxing a spinal column of a person, comprising:

a displacement carriage for receiving the person; and a horizontal linear guide track, along which the displacement carriage is guided and movable such that kinetic energy is exerted at least temporarily onto the person for distraction of the torso or spinal column of the person, wherein the displacement carriage has a pad for receiving the person in a reclining position, and the displacement carriage is configured to fix hips, legs and/or feet of the person, wherein the displacement carriage is designed for receiving the reclining person as a whole, and in the linear guide track a drive for reversing displacement of the displacement carriage with a defined speed progression is provided, wherein when in use, in the linear guide track, on a forward path the displacement carriage with the person reclining in a displacement direction is initially accelerated at a first speed progression and then braked in a first manner, wherein a first distraction of the torso and/or the spinal column takes place, and wherein when in use, subsequently, on a return path the displacement carriage with the reclining person is accelerated at a second speed progression that is higher than the first speed progression and then braked in a second manner that is more gentle than the first manner, wherein during the acceleration on the return path, a second distraction of the torso and/or the spinal column takes place.

2. The device according to claim 1, wherein the pad has a reclining surface for the torso of the person, wherein the reclining surface is designed to enable a relative movement of the torso with respect to the fixed hips, legs and/or feet of the person.

3. The device according to claim 1, wherein to receive the person the pad can be pivoted at least partially into an upright receiving position.

4. The device according to claim 1, wherein on the pad a support is provided which has a prismatic shape and is designed for supporting the legs in an upward-bent position.

5. The device according to claim 4, wherein hand grips are attached on the support.

6. The device according to claim 1, wherein the pad is configured to receive the person reclining in a horizontal position.

7. A method for training muscles of an upper torso and/or for relaxing a spinal column of a person, with a displacement carriage for receiving the person and with a linear guide track, along which the displacement carriage with the person is guided and moved, the method comprising:

receiving the person as a whole on the displacement carriage in a reclining position on a pad, fixing hips, legs and/or feet of the person on the pad, displacing the displacement carriage with the reclining person along the guide track in a horizontal manner, initially accelerating at a first speed progression on a forward path the displacement carriage with the person reclining in a displacement direction and then braking the displacement carriage in a first manner, wherein a first distraction of the torso and/or the spinal column takes place, and subsequently, accelerating at a second speed progression that is higher than the first speed progression on a return path the displacement carriage with the reclining person and then braking the displacement carriage in a second manner that is more gentle than the first manner, wherein during the acceleration on the return path, a second distraction of the torso and/or the spinal column takes place.

8. The method according to claim 7, wherein the pad is configured to receive the person reclining in a horizontal position.

* * * * *